United States Patent [19]

Montgomery

[11] 4,298,146

[45] Nov. 3, 1981

[54] ONE-PIECE DISPENSING CLOSURE

[75] Inventor: Gary V. Montgomery, Evansville, Ind.

[73] Assignee: Sunbeam Plastics Corporation, Evansville, Ind.

[21] Appl. No.: 69,116

[22] Filed: Aug. 23, 1979

[51] Int. Cl.[3] ..... B65D 47/08

[52] U.S. Cl. ..... 222/536; 222/543; 222/556

[58] Field of Search ..... 222/521, 543, 546, 525, 222/556, 536, 537

[56] References Cited

U.S. PATENT DOCUMENTS

| | | | |
|---|---|---|---|
| 1,842,674 | 1/1932 | Jones | 222/521 |
| 2,998,902 | 9/1961 | Thomas et al. | 222/525 X |
| 3,124,281 | 3/1964 | Stull | 222/543 X |
| 3,201,013 | 8/1965 | Porter et al. | 222/525 |
| 3,208,650 | 9/1965 | Laham | 222/543 |
| 3,227,332 | 1/1966 | Gowdy et al. | 222/543 X |
| 3,255,928 | 6/1966 | Foster | 222/543 X |
| 3,439,842 | 4/1969 | Stull | 222/525 X |
| 4,020,981 | 5/1977 | Nixdorff | 222/525 |
| 4,172,540 | 10/1979 | Erichson | 222/543 X |

*Primary Examiner*—Robert J. Spar
*Assistant Examiner*—Frederick R. Handren
*Attorney, Agent, or Firm*—Fisher, Gerhardt, Crampton & Groh

[57] ABSTRACT

A one-piece dispensing closure consists of a cup-shaped cap having means for retaining it on the neck of a container and a lid which is connected by an integral hinge to the cap at one edge thereof and which is adapted to be swung over on top of the cap There are openings through the top of the cap and through the lid, one of which is closed by a stopper element when the lid is swung over and pressed down into closed position against the top of the cap. The relative positions and sizes of the opening in the lid and the stopper element are such that the stopper is withdrawn from the opening when the lid is lifted angularly a short distance to open position by raising the edge of the lid opposite the hinge connection. The cap and lid have cooperating means for limiting the normal, upward, angular movement of the lid away from closed position to open position.

8 Claims, 7 Drawing Figures

ONE-PIECE DISPENSING CLOSURE

BACKGROUND OF THE INVENTION

Many liquid or semi-liquid products have been packaged in bottles or other containers provided with dispensing valves or nozzles from which quantities of the material can be dispensed when desired, the valves usually providing for both "open" and "closed" positions.

Most of the dispensing closures or valves which previously have been suggested consist of two or more pieces one of which must be manually moved relative to the other in order to open the valve. This requires that the user hold the container in one hand and open the valve member with the other hand.

In addition, manufacture of two-part dispensing valves or closures requires that two separate mold cavities be designed and employed, one for each of the two parts and that these parts be assembled to each other either manually or by assembly machinery before they are attached to the respective containers. The cost of these two-part valves or closures is therefore increased by the necessity for amortizing the cost of the two separate molds and the cost of the manual assembly or the assembly machine.

Examples of the closures or valves of the type just discussed are shown in Collins U.S. Pat. No. 2,901,153 and Hazard U.S. Pat. No. 4,081,113. Although the dispensing valve of 2,901,153 is shown as being in place in the lid of a can-like container 14, similar dispensing valves are also provided in screw-on or snap-on caps for other types of containers. While the closure of U.S. Pat. No. 4,081,113 is shown as also having a so-called "child resistant" feature, similar dispensing closures without the child resistant feature have been utilized on many containers for products as different as cigarette lighter fluid, charcoal igniting fluid, hand cream, dishwashing liquids, etc.

It is customary for the manufacture of such a closure to assemble them in "closed" condition and to ship them to the organization which fills the containers so that they can be placed on the containers after they are filled by the use of automatic capping machinery. As a result, of course, the cost of assembling the two pieces of two-part closures or valves must be borne by the manufacturing company and included in the cost to their customer.

From the standpoint of the final user, for example, a housewife, it would be preferable if the closure or valve could be opened by the fingers of the same hand which is holding the container. Such action is not possible in the types of closures and valves of which the two mentioned patents are examples.

It is therefore the principal object of the instant invention to provide a dispensing closure for liquid and semi-liquid materials which is adapted to be placed on containers by the use of automatic capping machinery and yet which makes it possible for the ultimate user to open the valve or closure with the fingers of the same hand which is holding the container.

Another object of the present invention is to provide a dispensing closure which is a unitary structure, i.e., is a one-piece construction and thus can be fabricated in molds having a plurality of single cavities, the unitary structure including both the cap portion which is adapted to be placed on the neck of the container and a stopper or plug which is moveable to both "closed" and "open" positions.

It is yet another object of the instant invention to provide a one-piece dispensing closure which readily can be manufactured at high speed and in multi-cavity dies of a molding machine and the integral parts of which can be put in "closed" position by accessory mechanisms in the molding machine thereby eliminating manual assembly or the use of additional assembly machines.

And yet another object of the invention is to provide a unitary dispensing closure which can be produced at high speed in a multi-cavity die of an injection molding machine with the parts thereof in such position relative to each other as to make possible production in that fashion and the parts of which relatively easily can be moved to "closed" position and ejected from the molding machine in condition for direct shipment to the manufacturing user without further assembly or manufacturing steps.

DESCRIPTION OF PREFERRED EMBODIMENT

Figure 1:
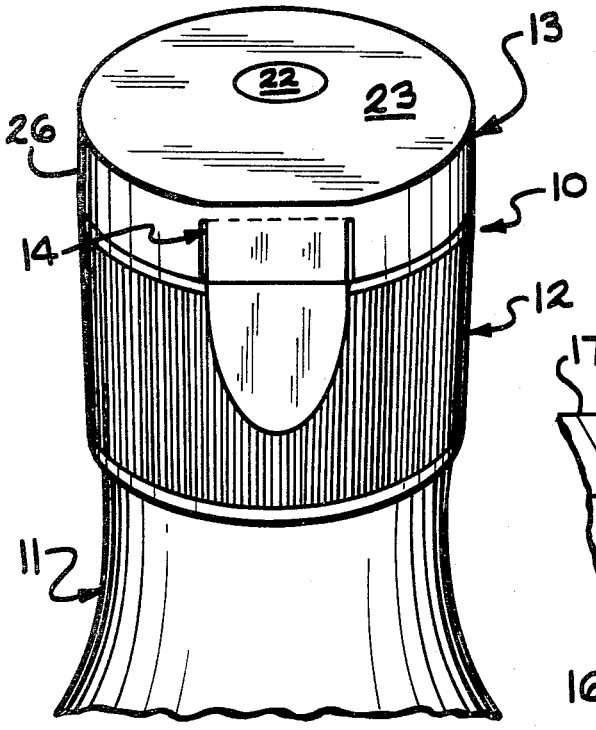
FIG. 1 is a fragmentary, isometric view of a closure embodying the invention on a container and shown in "closed" condition.

A closure embodying the invention is generally indicated by the reference number 10 and is shown in position on a neck 11 of a container on which it is to be used. The closure 10 comprises two major parts, i.e., a cap 12 and a lid 13 which are integrally connected to each other by a hinge 14. It will be appreciated that a closure of this type preferably is molded from a resilient, though tough resilient, material such as polypropylene, or the like.

The closure 10 is retained on the container neck 11, for example, by a thread 15 on the cap 12 which mates with a thread 16 on the container neck 11. Inasmuch as threads of this type are conventional, closure 10 of the invention readily can be provided with other means to cooperate with different means on the container neck 11 for retaining the closure on a container.

The cap 12 has a generally disk-shaped top 17 through which there is formed a dispensing opening consisting of two segment-like portions 18 and 19 through the top 17 which are located on opposite sides of a bridge 20 extending across the circle of which the portions 18 and 19 are segments. The open portions 18 and 19 are surrounded by an annular wall 21 which extends upwardly from the cap top 17. A generally cylindrical plug 22 extends upwardly from the bridge 20 and is concentric with the wall 21.

Figure 6:
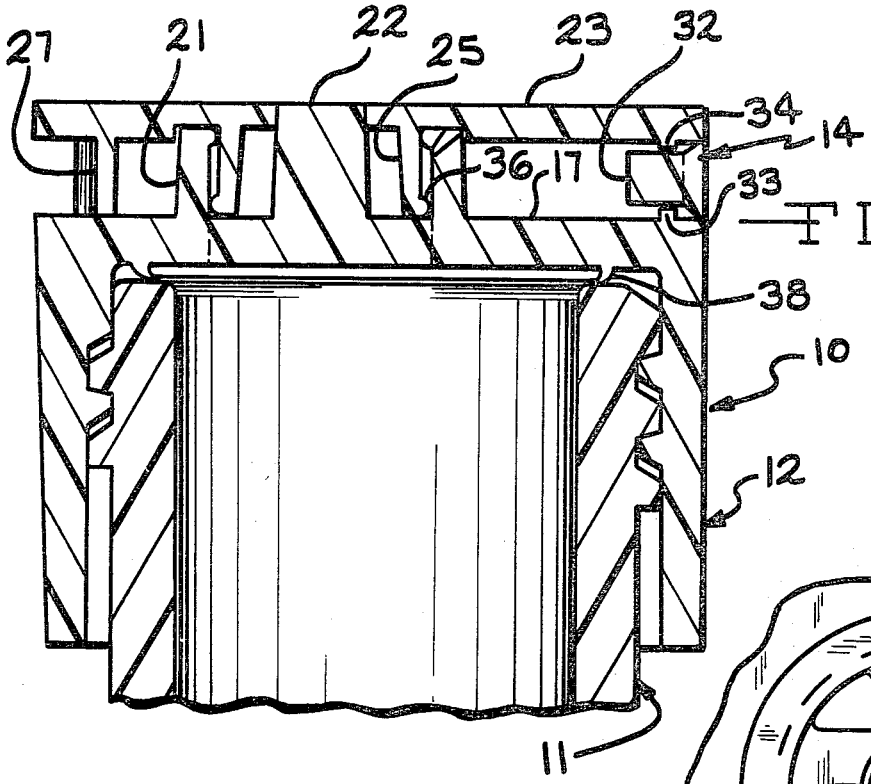
FIG. 6 is a vertical sectional view of a closure embodying the invention in "closed" position and is shown on the neck of a container which is fragmentarily illustrated.
Figure 7:
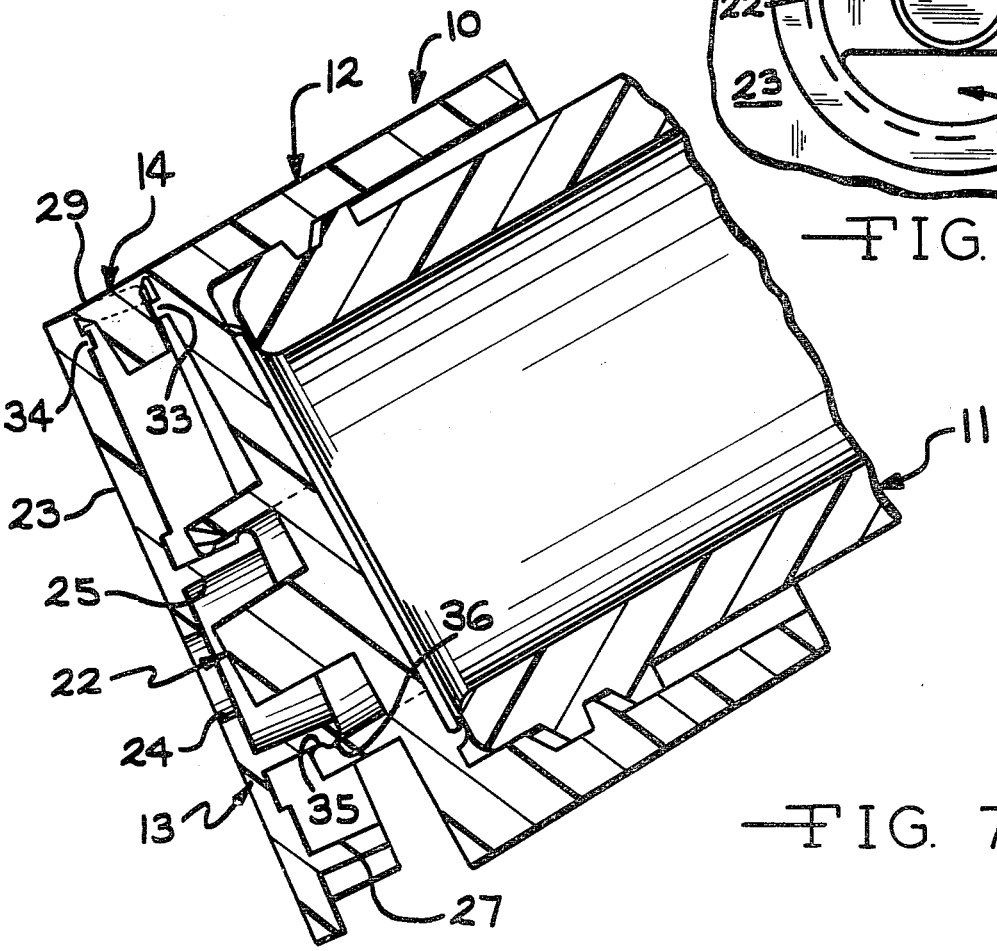
FIG. 7 is a view similar to FIG. 6 but showing the closure embodying the invention in "open" position on the neck of a container.

The lid 13 also has a disk-shaped top 23 through which extends a dispensing opening 24. The opening 24 is concentric with and surrounded by an annular wall 25 of such size as to mate with the wall 21 on the cap 12 when the closure is moved to closed and dispensing positions illustrated, respectively, in FIGS. 6 and 7. The lid also has a rim 26 which extends around its perimeter except for a re-entrant portion 27 which provides for an undercut as shown in FIGS. 6 and 7 and as will later be more fully described.

Figure 3:
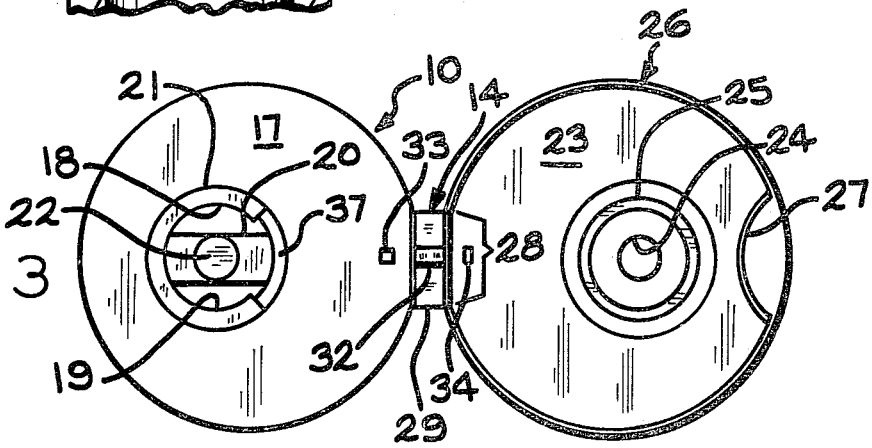
FIG. 3 is a top plan view of the closure as shown in FIG. 2.

As can best be seen in FIG. 3 the rim 26 terminates at opposite edges of the hinge 14 thus providing a gap indicated in that figure by the bracket 28 into which the hinge 14 recesses when the closure is in fully closed position, as best shown in FIG. 1.

Figure 4:
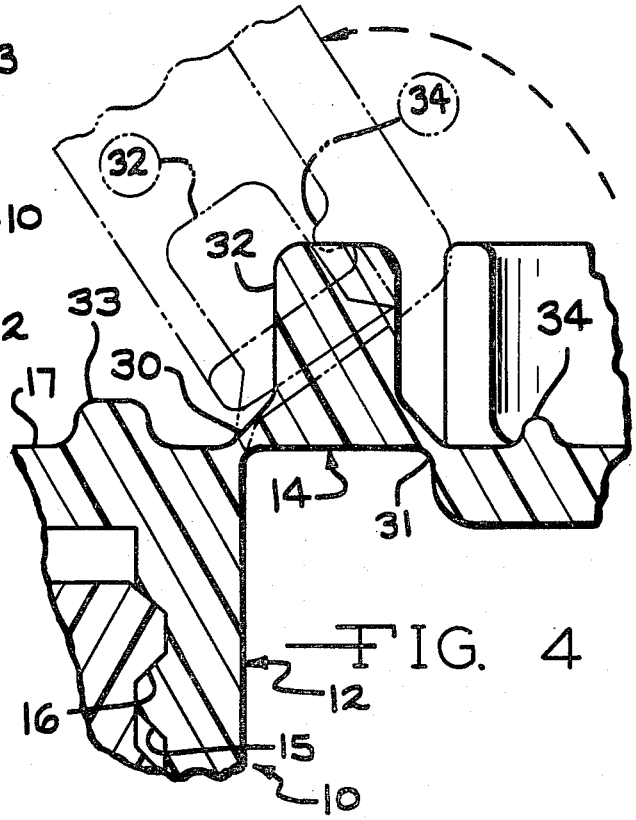
FIG. 4 is a greatly enlarged, fragmentary, vertical sectional view including the portions within the indicated circle in FIG. 2 and also showing parts of the closure in broken lines illustrating how the closure parts are moved from their initially molded position shown in FIGS. 2 and 3 toward closed position.

The hinge 14 has a flat web 29 and a pair of thin sections 30 and 31 (see FIG. 4 particularly) which are at opposite sides of the web 29 and, respectively, extend substantially tangentially to the edges of the cap top 17 and the lid top 23. The portions 30 and 31 provide flexure lines for the hinge 14. Three spacer elements 32 on the hinge web 29, 33 on the cap top 17 and 34 on the underside of the lid top 23 are serially engaged with each other when the lid 13 is moved from the molded position illustrated in FIG. 4. to the closed position illustrated in FIG. 6. In FIG. 4 the several spacers 32, 33 and 34 are shown in broken lines as they engage each other during the movement between the two positions discussed. The serial engagement of the spacers 32, 33, and 34 insures that as the hinge flexure sections 30 and 31 are bent during the swinging movement of the lid 13 from the position of FIG. 2 to the position of FIG. 6, the two walls 21 and 25 will inter-engage in telescoping relationship and the upper end of the plug 22 will enter the dispensing opening 24 in the lid 13 as the lid 13 reaches the closed position of FIG. 6.

Figure 5:
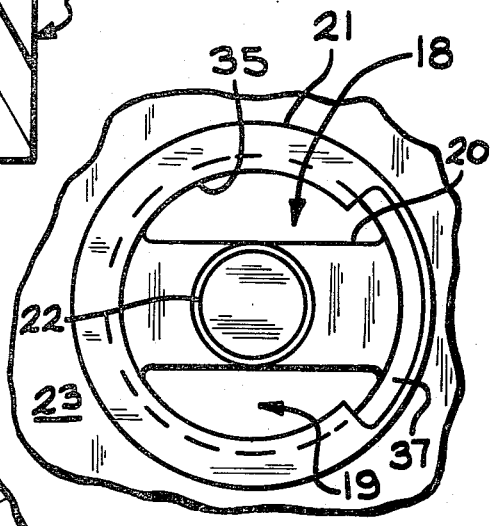
FIG. 5 is a fragmentary, top plan view taken from the position indicated by the line 5—5 of FIG. 2.

Each of the two circular walls, 21 on the cap top 17 and 25 on the lid portion top 23, has a lip 35 or 36, respectively. The lips 35 and 36 are of such inner or outer diameters, respectively, that they inter-engage with each other when the lid 13 is swung over to the closed position of FIG. 6. In order to facilitate the entry of the lip 36 through the space defined by the lip 35, a portion 37 of the lip 35 may be cut away as best illustrated in FIG. 5.

Figure 2:
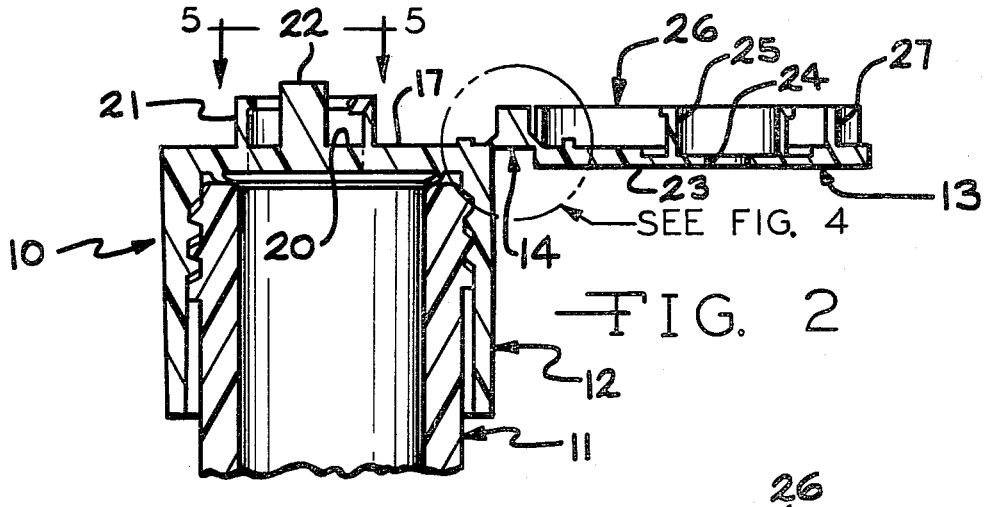
FIG. 2 is a vertical sectional view taken along a diameter of a closure embodying the invention and illustrating the parts thereof in the positions in which they initially are molded.

After closures embodying the invention have been molded in the position shown in FIG. 2 and the lids 13 have been swung upwardly and over through the intermediate position shown in FIG. 4 to the closed position illustrated in FIG. 6 the closures 10 then are in appropriate condition to be shipped by the manufacturer to the container filling location where content material is placed in the containers and the closures are assembled thereon by automatic capping machines. The embodiment of the invention illustrated in the drawings has a sealing fin 38 on the underside of the cap top 17 which is squeezed tightly against the end of a container neck 11 to seal the container or, if preferred, of course, a conventional liner may be employed rather than the fin 38.

When the filled, closed container is received by the ultimate user, such as a housewife or other person who wishes to dispense material from the container, this readily may be accomplished by utilizing the fingers of the hand holding the container to lift the lid 13 angularly into dispensing position illustrated in FIG. 7. It will be noted that by thus lifting that edge of lid 13 opposite to the hinge 14, the plug 22 is withdrawn from the dispensing opening 24 in the lid 13 so that content material may be dispensed through the segment like portions 18 and 19 of the opening to the cap top 17 and the dispensing opening 24 in the lid 13. The lips 35 and 36 on the respective walls 21 and 25 engage each other when the lid 13 is swung to dispensing position (FIG. 7) thus indicating to the user that the closure is open and material may be dispensed from the container. Conversely, by reason of the fact that the end of the plug 22 is visible, obviously closing the dispensing opening 24, when the closure is in "closed" position as illustrated in FIGS. 1 and 6, it is quite apparent to the user that material cannot be dispensed until the closure lid 13 is moved to the position shown in FIG. 7. Furthermore, by reason of the fact that plug 22 extends into the dispensing opening 24 when the closure is "closed", content material which may remain within the area defined by the wall 25 of the lid 13 and the segment-like opening portions 18 and 19 from a previous dispensing action, is not exposed to atmosphere and thus is subject to neither oxidation nor desication. As a result there is no "plug" of content material which must be forced or otherwise cleared out of the dispensing openings when it is desired to dispense a subsequent quantity of material from a container.

Moving the lid 13 from the "closed" position shown in FIG. 6 to the dispensing or "open" position of FIG. 7, is facilitated by the space beneath the edge of the lid top 17 provided by the re-entrant rim portion 27, and into which the user may insert a thumb nail or finger nail.

Having described my invention, I claim:

1. A dispensing closure for a liquid container comprising: a cap having means for retaining it on the neck of a container and a top with a dispensing opening therethrough, a lid having a dispensing opening therethrough, an integral hinge connecting said cap and said lid and constraining said lid for angular movement of said lid to and from a closed position when said lid is pressed down against the top of said cap, a plug on one of said cap and said lid of such size as to extend into and close the dispensing opening in the other of said cap and said lid when said lid is in the closed position, and cooperating means including portions on said cap and said lid engageable for normally limiting the relative angular movement of said lid and said cap about said hinge from the closed position to an open dispensing position in which said plug is withdrawn from the dispensing opening in the other of said cap and said lid and in which said lid overlies and engages with said cap to resist further relative opening movement.

2. A dispensing closure according to claim 1 in which the co-operating means on the cap and the lid are circular walls on the upper side of the cap top and the underside of the lid top which are adapted to telescopingly mate when said lid is in closed position and to remain mated when said lid is angularly moved away from the closed position a distance sufficient to withdraw the plug from the dispensing opening.

3. A dispensing closure, according to claim 1, said top having an upwardly extending first circular wall surrounding the dispensing opening, said lid having a second circular wall on its underside adapted to telescopingly mate with said first circular wall when said cap is in the closed position.

4. A dispensing closure, according to claim 3, wherein said cooperating means including portions are opposed interengaging lips on the mating first and second circular walls.

5. A one-piece dispensing closure for a liquid container, said closure comprising:

(a) a generally cup-shaped cap having means for retaining it on the neck of a container, said cap having a generally disc-shaped top with a dispensing opening therethrough, (b) a generally saucer-shaped lid having a disc-like top of substantially the same diameter at the top of said cap and which has a dispensing opening therethrough, (c) an integral hinge connecting said cap and said lid, said hinge constraining said lid for angular movement to and from a closed position with said lid pressed down against the top of said cap, said integral hinge having two spaced, thinner sections forming flexure lines which are substantially tangential to the edges of the cap and the lid, respectively, (d) a plug on one of said cap and said lid of such size as to extend into and close the dispensing opening in the other of said cap and said lid when said lid is in the closed position, and (e) co-operating means on said cap and said lid spaced from said hinge for normally limiting the angular movement of said lid relative to said cap from the closed position to an open dispensing position in which said plug is withdrawn from the dispensing opening in the other of said cap and said lid and in which said lid overlies and engages with said cap to resist further angular opening movement.

6. A one-piece dispensing closure according to claim 5 in which there are serially engageable spacer elements (a) on the hinge between the thinner flexure sections, (b) on the upper side of the top of the cap and (c) on the underside of the top of the lid, the latter two of said elements, respectively, being located at points outwardly spaced from said thinner flexure sections.

7. A dispensing closure for a liquid container comprising: a cap having means for retaining it on the neck of a container and a top with a dispensing opening therethrough, a lid having a dispensing opening therethrough, an integral hinge connecting said cap and said lid and constraining said lid for angular movement to and from a closed position when said lid is pressed down against the top of said cap, said integral hinge including a center web and two spaced thinner sections forming flexure lines, a plug on one of said cap and said lid of such size as to extend into and close the dispensing opening in the other of said cap and said lid when said lid is in the closed position, and co-operating means on said cap and said lid for normally limiting the relative angular movement between said lid and said cap from the closed position to an open dispensing position in which said plug is withdrawn from the dispensing opening in the other of said cap and said lid and in which said lid overlies and engages with said cap to resist further relative opening movement.

8. A dispensing closure, according to claim 7, including serially engageable spacer elements on the hinge, cap and top.

* * * * *